US007403182B2

(12) United States Patent
Lee

(10) Patent No.: US 7,403,182 B2
(45) Date of Patent: Jul. 22, 2008

(54) LIQUID CRYSTAL DISPLAY AND DRIVING APPARATUS THEREOF

(75) Inventor: Seung-Woo Lee, Seoul (KR)

(73) Assignee: Samsung Electronics Co., Ltd. (KR)

( * ) Notice: Subject to any disclaimer, the term of this patent is extended or adjusted under 35 U.S.C. 154(b) by 738 days.

(21) Appl. No.: 10/340,178

(22) Filed: Jan. 10, 2003

(65) Prior Publication Data

US 2003/0222839 A1 Dec. 4, 2003

(30) Foreign Application Priority Data

May 30, 2002 (KR) ..... 10-2002-0030266

(51) Int. Cl.
*G09G 3/36* (2006.01)

(52) U.S. Cl. ..... 345/89; 345/690

(58) Field of Classification Search ..... 345/88, 345/87, 89, 102, 104, 98, 99, 100, 690, 605, 345/600; 358/1.9, 2.1, 3.01; 382/169; 360/48
See application file for complete search history.

(56) References Cited

U.S. PATENT DOCUMENTS 5,764,216 A * 6/1998 Tanaka et al. ..... 345/87
5,861,962 A * 1/1999 Maeda ..... 358/451
5,870,503 A * 2/1999 Kumashiro ..... 382/252
6,118,547 A * 9/2000 Tanioka ..... 358/1.9
6,320,594 B1 * 11/2001 Young ..... 345/605
6,344,857 B1 2/2002 Matono et al.
6,492,983 B2 * 12/2002 Nishitani et al. ..... 345/213
6,559,822 B2 5/2003 Okuzono
2003/0222839 A1 12/2003 Lee

FOREIGN PATENT DOCUMENTS

JP 02295390 12/1990
JP 06335013 12/1994
JP 2000056525 2/2000

* cited by examiner

*Primary Examiner*—Abbas I Abdulselam
(74) *Attorney, Agent, or Firm*—Cantor Colburn LLP

(57) ABSTRACT

A liquid crystal display, including a signal controller having a logic circuit correcting n-bit source image data inputted from an external device into m-bit first corrected data and a multi-level graying unit converting the m-bit first corrected data into second corrected data with a bit number equal to or less than n bits, and a data driver outputting data voltages corresponding to the second corrected data from the signal controller, is provided. The signal controller classifies the source image data into at least two sections and corrects the source image data into the first corrected data based on gamma correction data predetermined by gamma characteristics of the source image data for each of the at least two sections.

12 Claims, 9 Drawing Sheets

LIQUID CRYSTAL DISPLAY AND DRIVING APPARATUS THEREOF

BACKGROUND OF THE INVENTION (a) Field of the Invention

The present invention relates to a liquid crystal display and driving apparatus thereof.

(b) Description of the Related Art

In recent years, as personal computers or television sets have been lighter-weight and slimmer, a flat panel display ("FPD") such as a liquid crystal display ("LCD") has been developed.

LCDs include two panels and a liquid crystal layer with dielectric anisotropy disposed therebetween, and display desired images by adjusting the strength of the electric field applied to the liquid crystal layer to control the amount of light passing through the panels. The LCDs are representative FPDs, and the LCDs using thin film transistors ("TFTs") as switching elements are widely used.

The electro-optical characteristics of red color ("R"), green color ("G") and blue color ("B") pixels in an LCD are different. Nevertheless, current LCD products utilize identical electric signals for all the pixels under the assumption that the electro-optical characteristics of these pixels are equal. The transmittance curves as a function of gray voltage (hereinafter, referred to as "gamma curves") for respective R, G and B pixels do not match one another. Accordingly, the color impression of grays is not uniform for R, G and B pixels or is seriously concentrated on one of R, G and B pixels.

For example, in patterned and vertically-aligned ("PVA") LCDs, R pixels are predominant in bright grays while B pixels are predominant in dark grays. Therefore, an arbitrary color becomes to look blue as the gray goes darker. In particular, there is a problem that the impression of a human face displayed in dark grays is cold due to conspicuousness of a blue color.

SUMMARY OF THE INVENTION

The present invention provides a liquid crystal display capable of performing color-correction of a RGB gamma curve.

The present invention independently transforms RGB image data.

According to one aspect of the present invention, a liquid crystal display includes a signal controller including a logic circuit correcting n-bit source image data inputted from an external device into m-bit first corrected data, and a multilevel graying unit converting the m-bit first corrected data into second corrected data with a bit number equal to or less than the n bits of the source image data. The liquid crystal display further includes a data driver outputting data voltages corresponding to the second corrected data from the signal controller. The logic circuit classifies the n-bit source image data into at least two sections and correcting the n-bit source image data into the m-bit first corrected data based on gamma correction data predetermined by gamma characteristics of the n-bit source image data for each of the at least two sections.

The liquid crystal display preferably further includes a memory storing a parameter required for the correction. The memory may be provided in or external to the signal controller.

The logic circuit adds a correction value obtained by the correction to the n-bit source image data multiplied by four, and converts the result of the addition into the m-bit first corrected data.

Preferably, the logic circuit calculates the correction values in a first section and a second section differentiated by a boundary value based on the followings:

$$MD_1 - MD_1 \times \left\{ \frac{(D - BB)}{UN} \right\}^{UO}; \text{ and}$$

$$MD_2 - MD_2 \times \left\{ \frac{(BB - D)}{DN} \right\}^{DO},$$

respectively, where D is the n-bit source image data, BB is the boundary value, UN and DN are respective sizes of the first and the second sections, UO and DO are orders of respective polynomials in the first and the second sections, and $MD_1$ and $MD_2$ are the maximum values of differences between the source image data and the gamma correction data for the first and the second sections. The memory preferably stores the maximum values of the differences between the source image data and the gamma correction data for the first and second sections, the sizes of the first and the second sections, and the orders of the polynomials for the first and the second sections.

The logic circuit determines the m-bit first correction data by $$Y_{\min} + \frac{(Y_{\max} - Y_{\min})}{(X_{\max} - X_{\min})}(X - X_{\min}),$$

where $X_{min}$ and $X_{max}$ are minimum and maximum boundary values of each of the at least two sections, $Y_{min}$ and $Y_{max}$ are the gamma correction data for $X_{min}$ and $X_{max}$, and X is the n-bit source image data.

The memory of the liquid crystal display may be a nonvolatile memory provided within the signal controller.

Alternately, the memory is provided external to the signal controller and the signal controller may further include a volatile memory temporarily storing the parameters stored in the memory and a memory controller loading the parameters stored in the memory to the volatile memory.

Alternately, the memory may further include first and second nonvolatile memories provided in an internal and an external sides of the signal controller, respectively, and the signal controller may further include a volatile memory temporarily storing the parameters stored in the first and the second nonvolatile memories and a memory controller loading the parameters stored in the first and the second nonvolatile memories to the volatile memory.

According to another aspect of the present invention, a driving apparatus of a liquid crystal display includes a logic circuit and a storage storing operation parameters of the logic circuit. The logic circuit classifies n-bit image data inputted from an external device into first and second sections with respect to a boundary gray value and corrects the n-bit image data into m-bit corrected data based on gamma correction data predetermined by gamma characteristics of the n-bit image data for each of the first and the second sections. The logic circuit adds correction values obtained by the correction to the n-bit image data multiplied by four, and converts the result of the addition into the m-bit corrected data.

The logic circuit preferably calculates the correction values in the first section and the second section based on the followings:

$$MD_1 - MD_1 \times \left\{ \frac{(D - BB)}{UN} \right\}^{UO}; \text{ and}$$

$$MD_2 - MD_2 \times \left\{ \frac{(BB - D)}{DN} \right\}^{DO},$$

respectively, where D is the image data, BB is the boundary gray value, UN and DN are respective sizes of the first and the second sections, UO and DO are orders of respective polynomials in the first and the second sections, and $MD_1$ and $MD_2$ are the maximum values of differences between the image data and the gamma correction data for the first and the second sections.

According to further aspect of the present invention, a driving apparatus of a liquid crystal display includes a logic circuit operates after classifying n-bit image data inputted from an external device into a plurality of sections on the basis of given number of grays and a storage storing the gamma correction data at boundary gray values of each of the sections. The logic circuit corrects the n-bit image data into m-bit corrected data based on gamma correction data predetermined by gamma characteristics of the n-bit image data for each of the sections. The logic circuit converts the n-bit image data into the m-bit corrected data for each of the sections.

It is preferable that the m-bit correction data is determined by a linear line defined by the boundary gray values for each of the sections.

The m-bit correction data may be determined by $$Y_{\min} + \frac{(Y_{\max} - Y_{\min})}{(X_{\max} - X_{\min})}(X - X_{\min}),$$

where $X_{min}$ and $X_{max}$ are minimum and maximum boundary gray values of each section, $Y_{min}$ and $Y_{max}$ are the gamma correction data for $X_{min}$ and $X_{max}$, and X is the image data.

DETAILED DESCRIPTION OF PREFERRED EMBODIMENTS

Preferred embodiments of the present invention now will be described more fully hereinafter with reference to the accompanying drawings. This invention may, however, be embodied in many different forms and should not be construed as limited to the embodiments set forth herein.

Now, LCDs and driving apparatus thereof according to embodiments of the present invention will be described with reference to the drawings.

First, referring to FIG. 1, an LCD according to an exemplary embodiment of the present invention will be described in detail.

Figure 1:
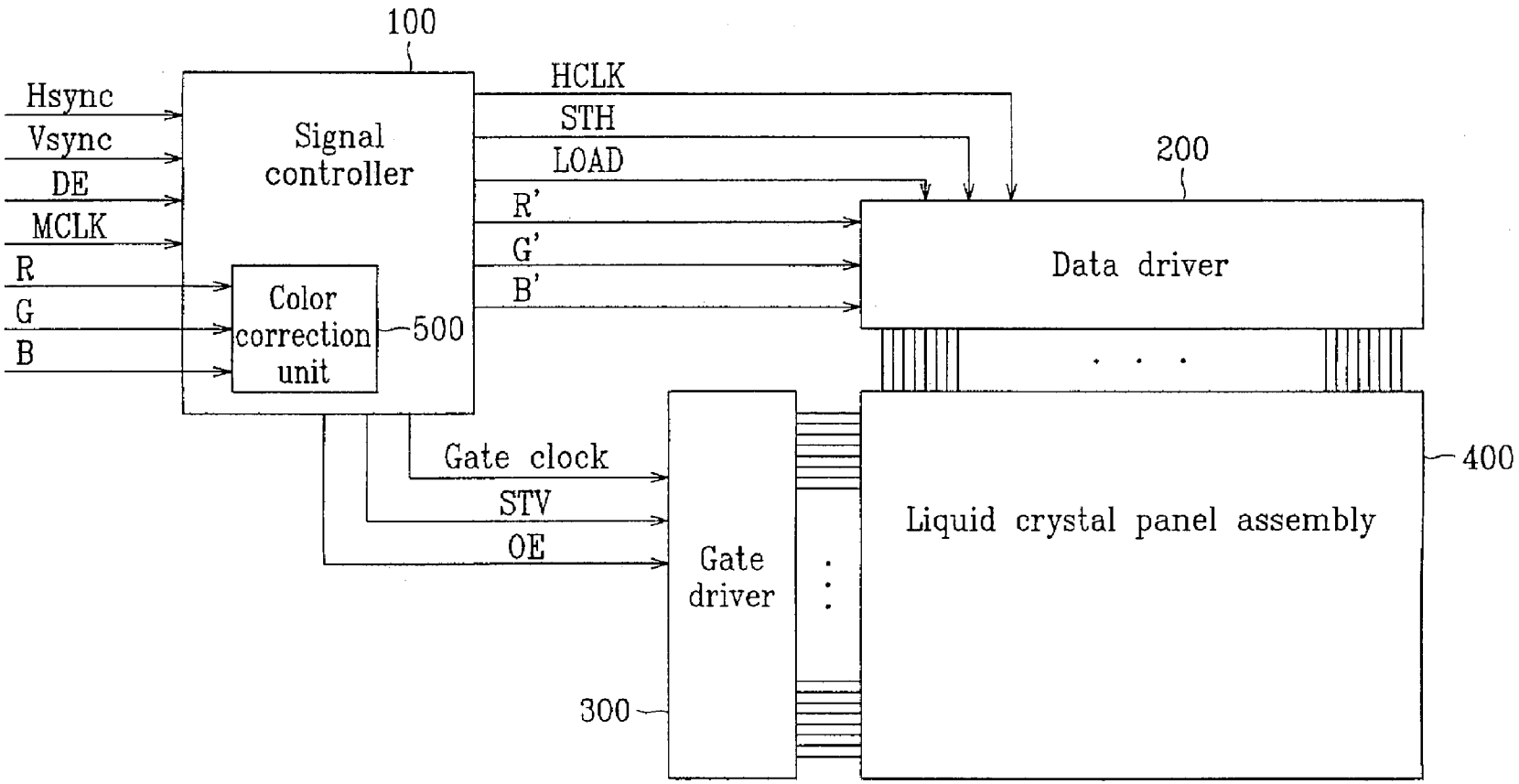
FIG. 1 shows an LCD according to an exemplary embodiment of the present invention.

FIG. 1 shows an LCD according to an embodiment of the present invention.

As shown in FIG. 1, an LCD according to an embodiment of the present invention includes a signal controller 100, a data driver 200, a gate drive 300 and a liquid crystal panel assembly 400.

The signal controller 100 receives RGB source image data, synchronization signals Hsync and Vsync, a data enable signal DE, a clock signal MCLK from an external graphic controller (not shown). The signal controller 100 color-corrects the RGB source image data (R, G, B) and outputs the corrected image data (R', G', B') to the data driver 200. In addition, the signal controller 100 generates timing signals, for example, HCLK, STH, LOAD, Gate clock, STV, or OE, for driving the data driver 200 and the gate driver 300 and outputs the timing signals thereto.

In the liquid crystal panel assembly 400, a plurality of gate lines (not shown) transmitting gate signals extends in a transverse direction and a plurality of data lines (not shown) transmitting data voltages extends in a longitudinal direction. In addition, a plurality of pixels (not shown) is arranged in a matrix, and displays images in response to the signals inputted through the gate lines and the data lines.

The data driver 200 selects gray voltages corresponding to the color-corrected RGB image data and applies the gray voltages as image signals to the data lines of the liquid crystal panel assembly 400 in synchronization with the timing signals. The gate driver 300 generates scanning signals based on voltages generated from a gate driving voltage generator (not shown) and applies the scanning signals to the gate lines of the liquid crystal panel assembly 400 in synchronization with the timing signals from the signal controller 100.

The signal controller 100 includes a color correction unit 500 for performing an adaptive color correction ("ACC"). The color correction unit 500 may be implemented externally to the signal controller 100. The color correction unit 500 receives the RGB source image data from an external device and outputs the RGB corrected image data (hereinafter, referred to as "ACC data").

For instance, the color correction unit 500 extracts the ACC data corresponding to the RGB source image data upon the input of the RGB source image data from an external device. The color correction unit 500 then multigray-converts the extracted ACC data and outputs the converted ACC data. The bit number of the ACC data before multigray conversion may be equal to or larger than that of the RGB source image data. The bit number of ACC data after multigray conversion is preferably equal to that of the RGB source image data.

Figure 2:
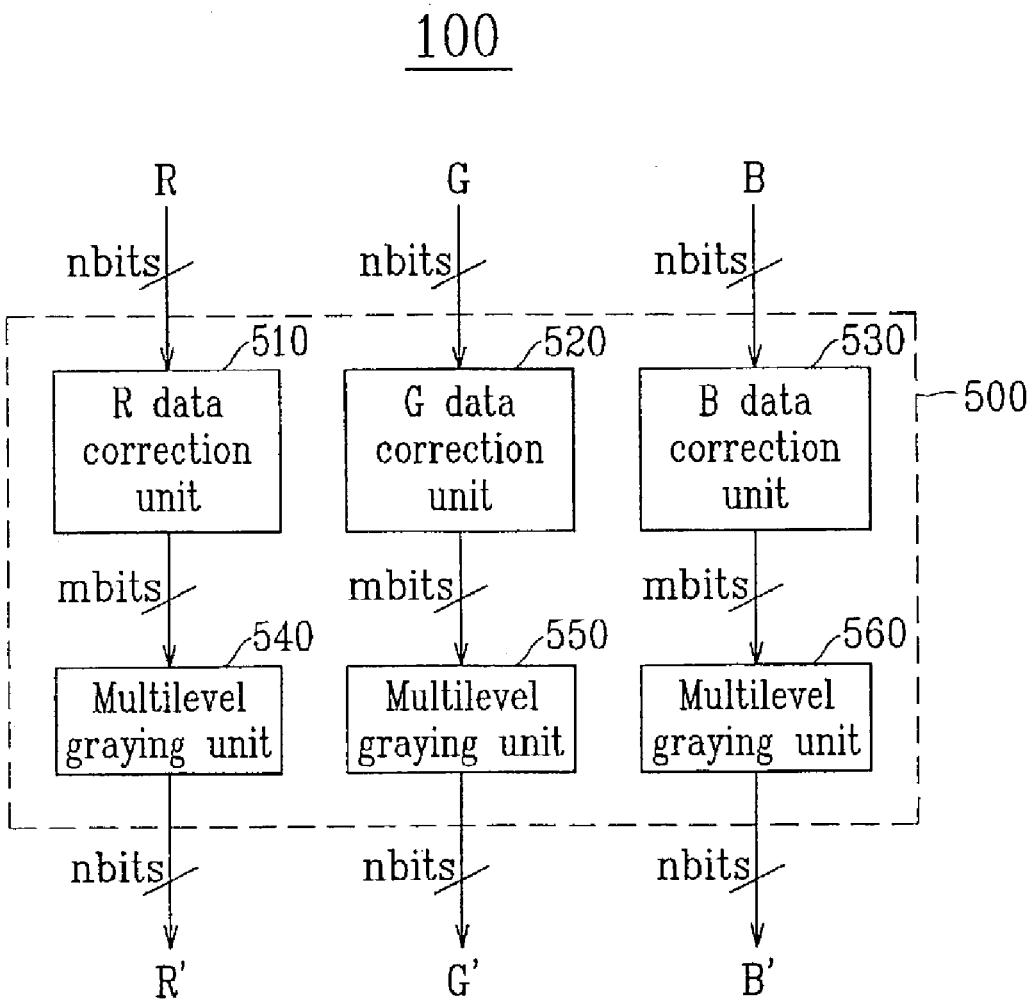
FIG. 2 shows a color correction unit according to a first embodiment of the present invention.
Figure 3:
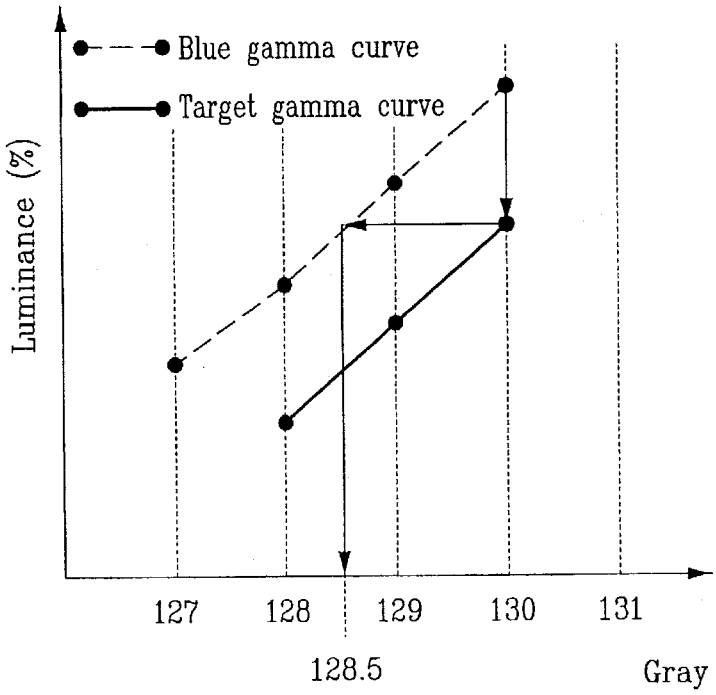
FIG. 3 shows a method for changing a B gamma curve into a target gamma curve according to the first embodiment of the present invention.

Referring to FIG. 2 and FIG. 3, a color correction unit 500 according to a first embodiment of the present invention will be described in detail now.

FIG. 2 shows a color correction unit according to a first embodiment of the present invention, and FIG. 3 illustrates a method for converting a B gamma curve into a target gamma curve according to the first embodiment of the present invention.

As shown in FIG. 2, a color correction unit 500 according to a first embodiment of the present invention includes a R data correction unit 510, a G data correction unit 520, a B data correction unit 530, and a plurality of multilevel graying units 540, 550 and 560 connected to the R, G and B data correction units 510, 520 and 530, respectively.

The R, G and B data correction units 510, 520 and 530 convert inputted n-bit RGB source image data into m-bit ACC data predetermined depending on the characteristics of an LCD, and output the converted ACC data to the corresponding multilevel graying units 540, 550 and 560. The R, G and B data correction units 510, 520 and 530 correct the gamma curves for the RGB source image data. The R, G and B data correction units 510, 520 and 530 include a ROM storing a lookup table (hereinafter, referred to as "LUT") for converting the n-bit RGB source image data into the m-bit ACC data. The R, G and B data correction units 510, 520 and 530 may include respective ROMs or may share a single common ROM.

The multilevel graying units 540, 550 and 560 convert the m-bit (m>n) ACC data into n-bit ACC data R', G' and B' and output the converted ACC data R', G' and B'. The multilevel graying units 540, 550 and 560 perform spatial dithering and temporal frame rate control (hereinafter, referred to as "FRC"). These multilevel graying units 540, 550 and 560 may be implemented into a single multilevel graying unit.

As shown in FIG. 3, in order to illustrate a method for converting a B (Blue) gamma curve into a target gamma curve, for example, assume that B image data representing the 130th gray is converted into B image data representing the 128.5th gray. In detail, the external B image data of the 130th gray is corrected into the B image data representing the gray, e.g., the 128.5th gray in the B gamma curve giving the same luminance in the target gamma curve represented by the 130th gray. This gray is stored in the LUT of the B data correction unit 530. If the inputted RGB source image data is 8-bit data, which cannot represent the 128.5th gray, the 128.5th gray may be represented by higher bit data. For example, the 128.5th gray may be represented by 514 (=128.5×4) using 10-bit data. It is apparent that the conversion using larger bits than the 8 bits enhances the effect of the color correction.

Accordingly, $2^n$ m-bit (m>n) ACC data corresponding to $2^n$ n-bit RGB image data inputted to the signal controller 100 is stored in the LUTs of the R, G and B data correction units 510, 520 and 530. Since data to be transmitted to the data driver 200 is represented by n or less bits, the multilevel graying units 540, 550 and 560 perform a spatial dithering and a temporal FRC for the m-bit ACC data and provide the dithered and FRCed data for the data driver 200.

Now, the dithering and the FRC of the multilevel graying units 540, 550 and 560 will be briefly described.

A pixel in the liquid crystal panel assembly 400 in one frame may be represented by two dimensional coordinates of X and Y. X represents the ordinals of transverse lines, and Y represents the ordinals of longitudinal lines. If a variant of time axis representing the ordinals of frames is set to a coordinate of Z, a pixel at a point is represented by three dimensional coordinates of X, Y and Z. A duty ratio is defined as a turned-on frequency of a pixel at a fixed X and Y divided by the number of the frames.

For example, the duty ratio 1/2 of a gray at (1, 1) means that the pixel at the position (1, 1) is turned on for one of two frames. For displaying various grays in an LCD, each pixel is turned on and off depending on the predetermined duty ratios for respective grays. A method of turning on and off the pixels as described above is called FRC.

However, when an LCD is driven by only FRC, adjacent pixels are turned on and off at the same time, this causes a flicker of flickering of a screen. To remove the flicker, dithering is used. The dithering is a technique controlling adjacent pixels given by a single gray to have different grays depending on the coordinates of the pixels, i.e., the ordinals of frames, vertical lines and horizontal lines.

Figure 4:
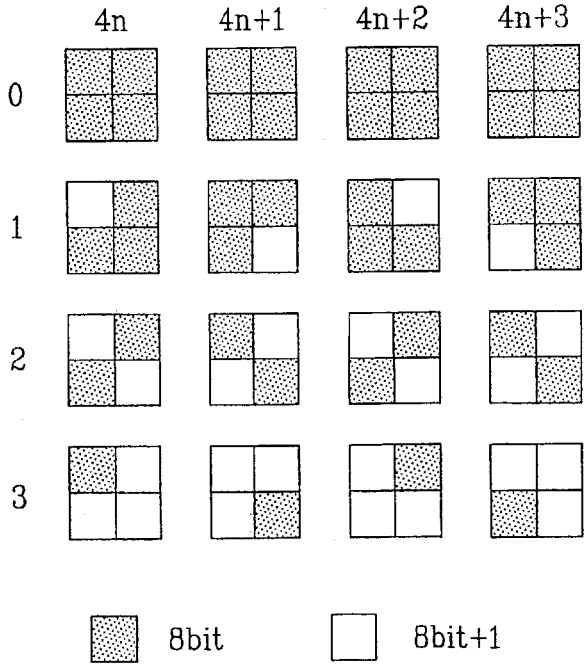
FIG. 4 shows a method for representing 10-bit ACC data as 8-bit data.

Referring to FIG. 4, dithering and FRC for representing 10-bit ACC data as 8-bit data will be now described.

FIG. 4 shows a method for representing 10-bit ACC data as 8-bit data.

10-bit ACC data is divided into higher 8-bit data and lower 2-bit data, the lower 2-bit data has one of the values "00", "01", "10" and "11". When the lower 2-bit data is "00", all of four adjacent pixels display the higher 8-bit data. When the lower 2-bit data is "01", one of four adjacent pixels displays a gray corresponding to sum of the value of the higher 8-bit data plus one (referred to as "the 8-bit plus one" hereinafter), and this equals to "01" on the average for the four pixels. The four pixels display the higher 8-bits plus one data in turn frame by frame, as shown in FIG. 4, so that such flicker is not generated.

Similarly, in case that the lower 2-bit data is "10", two of four adjacent pixels display the 8-bit plus one, and in case that the lower 2-bit data is "11", three of four adjacent pixels display the 8-bit plus one. Also, the adjacent four pixels display the 8-bit plus one in turn frame by frame for preventing flicker. FIG. 4 shows an example of altering the pixels displaying the 8-bit plus one in the 4n-th, (4n+1)-th, (4n+2)-th and (4n+3)-th frames.

Although the R, G and B data correction units 510, 520 and 530 in the first embodiment of the present invention include a ROM incorporated in the signal controller 100, the data correction units 510, 520 and 530 include a RAM for loading correction data from an external ROM. Hereinafter, such embodiments will be described with reference to FIGS. 5 and 6.

Figure 5:
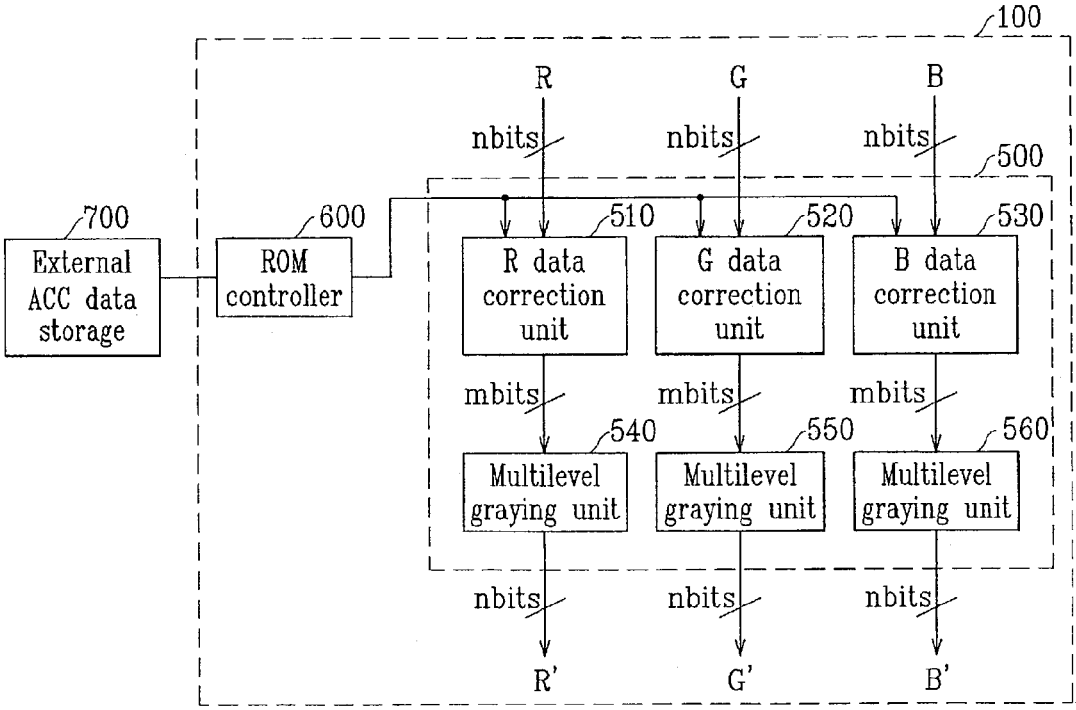
FIGS. 5 and 6 show color correction units and peripheral units thereof according to second and third embodiments of the present invention.
Figure 6:
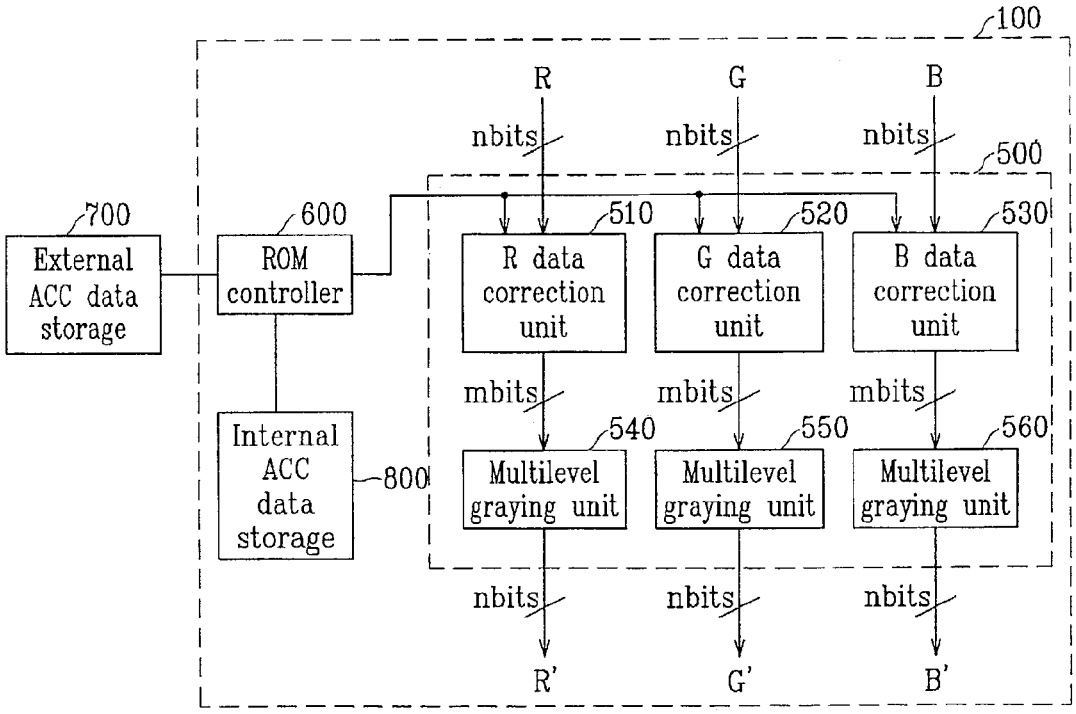

FIGS. 5 and 6 show color correction units and peripheral devices thereof according to second and third embodiments of the present invention, respectively.

As shown in FIG. 5, an LCD according to the second embodiment of the present invention further includes an external ACC data storage 700 and a ROM controller 600, and R, G and B data correction units 510, 520 and 530 include a volatile RAM.

An LUT storing the correction data described in the first embodiment is included in the external ACC data storage 700 and the ROM controller 600 loads the LUT included in the external ACC data storage 700 to the R, G and B data correction units 510, 520 and 530. The description of the following correction steps, which are substantially the same as those of the first embodiment, will be omitted.

According to the second embodiment of the present invention as described above, since the LUT is included in the external correction data storage 700, upon exchanging a liquid crystal panel assembly 400, an old LUT storing the correction data optimal to the liquid crystal panel assembly 400 is substituted with a new LUT, thereby easily optimizing the LCD.

An LCD according to a third embodiment of the present invention is nearly the same as that of the second embodiment excepting that a color correction unit 500 further includes an internal ACC data storage 800, as shown in FIG. 6.

In detail, the internal ACC data storage 800 as well as the external ACC data storage 700 includes an LUT as described above, and a ROM controller 600 loads the LUT included in the external ACC data storage 700 or the internal ACC data storage 800 to R, G and B data correction units 510, 520 and 530. Since subsequent operations are substantially the same as those of first embodiment, the description thereof will be omitted.

According to another embodiment of the present invention, ASICs may be used for implementing a function of the LUT to reduce a memory size of ROM or RAM in a LCD.

Hereinafter, such an embodiment will be described with reference to FIGS. 7 to 10.

Figure 7:
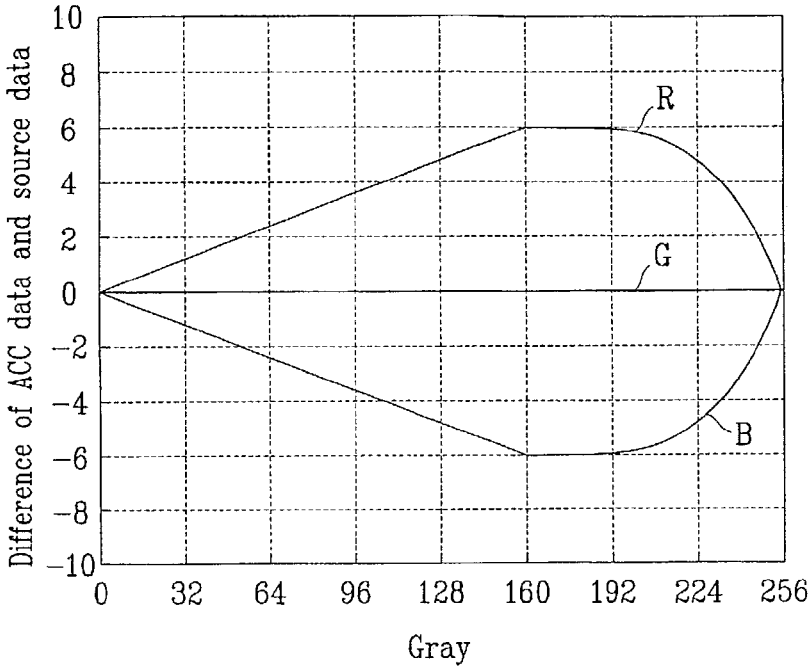
FIG. 7 shows the difference between ACC data and source image data.
Figure 8:
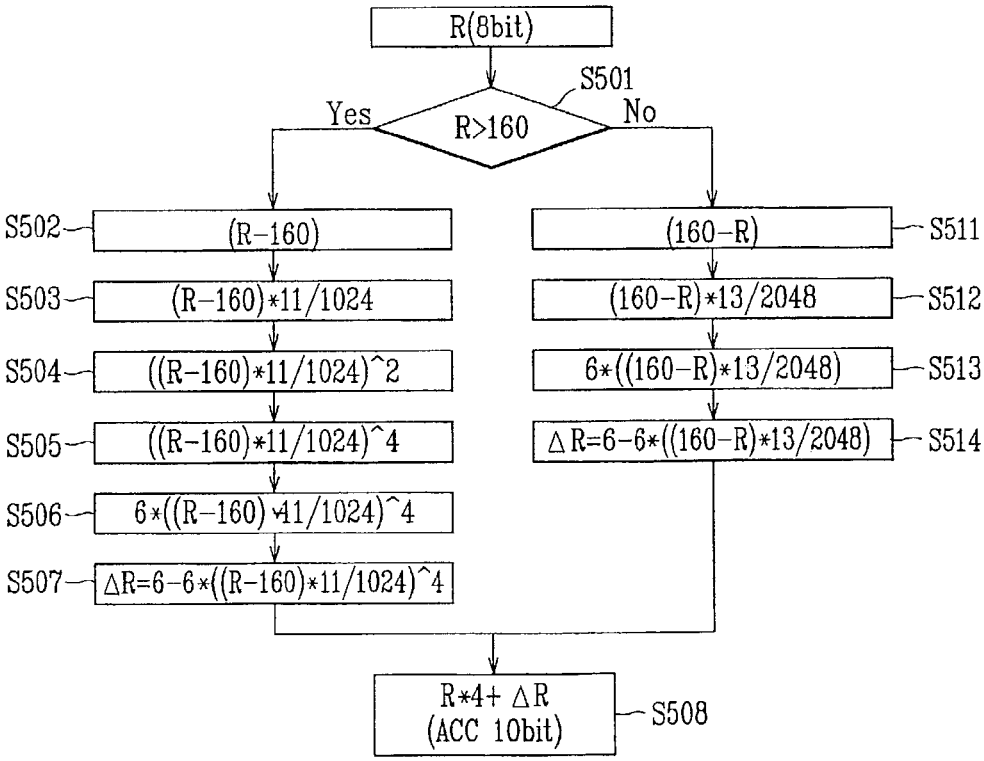
FIG. 8 is a flow chart showing a method for generating ACC data according to a fourth embodiment of the present invention.
Figure 9:
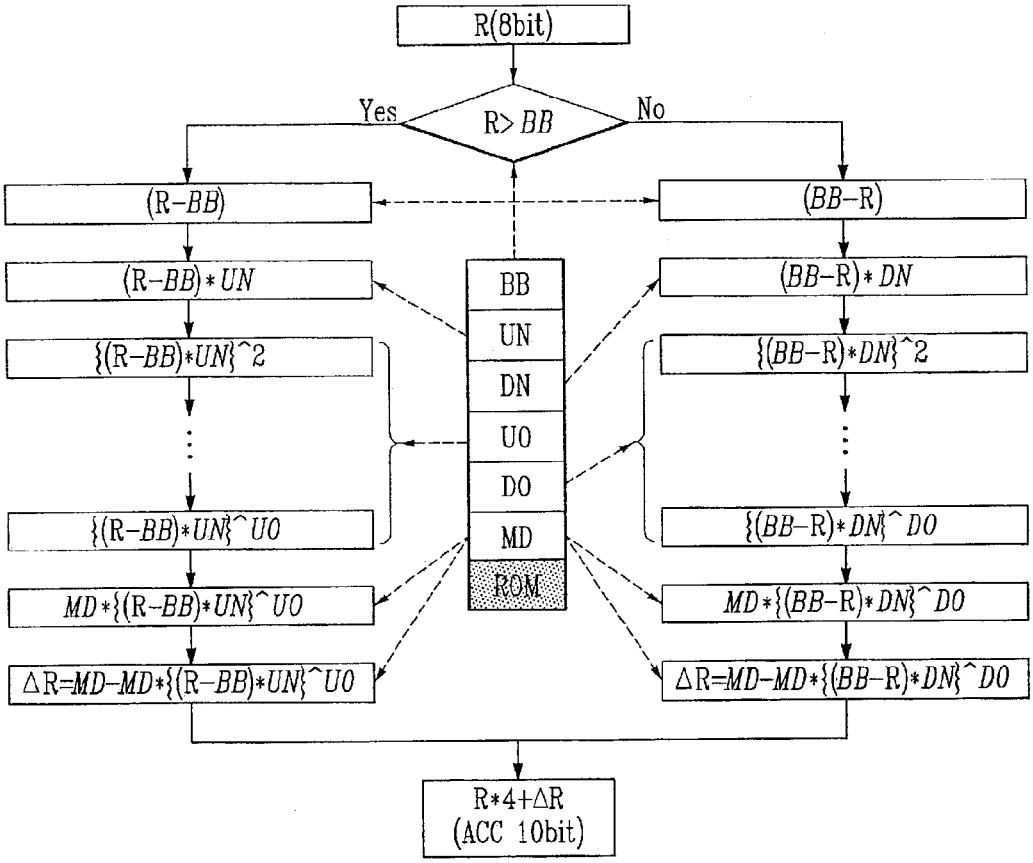
FIG. 9 illustrates a method for generating ACC data by loading parameters stored in a memory according to the fourth embodiment of the present invention.
Figure 10:
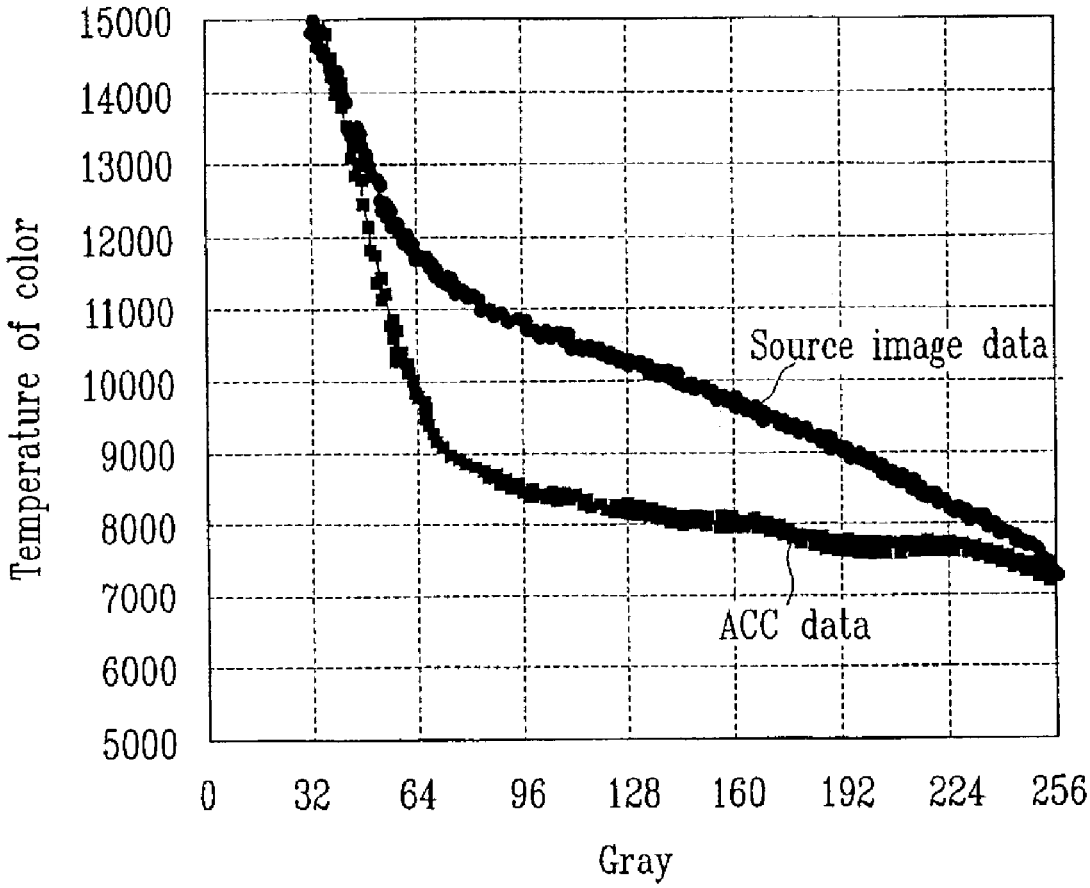
FIG. 10 shows corrected ACC data and R source image data according to the fourth embodiment of the present invention.

FIG. 7 shows the difference between ACC data and RGB source image data, and FIG. 8 is a flow chart showing a method for generating ACC data according to a fourth embodiment of the present invention. FIG. 9 shows a method for generating ACC data by loading parameters stored in a memory according to the fourth embodiment. FIG. 10 shows corrected ACC data and R source image data according to the fourth embodiment of the present invention.

In the fourth embodiment of the present invention, it is assumed that R, G and B source image data is 8-bit signals capable of representing 256 grays and that the difference between desired ACC data and R, G and B source image data is given as in FIG. 7. Here, the desired ACC data means color-correction image data determined depending on the characteristics of the liquid crystal panel assembly 400.

As shown in FIG. 7, desired ACC data for G source image data $G_{8bit}$ has no difference with G source image data, and the shapes of the respective curves showing differences between desired ACC data and source image data for R and G image data $R_{8bit}$ and $G_{8bit}$ become different with respect to the 160th gray. In consideration of this aspect, the respective differences ΔR and ΔB of R and B source image data $R_{8bit}$ and $B_{8bit}$ and ACC data $R_{ACC}$ and $B_{ACC}$ are approximately expressed by followings equations:

$$\Delta R = 6 - \frac{6\times(160 - R_{8bit})}{160} \text{ if } R_{8bit} < 160, \text{ and } \quad 6 - \frac{6\times(R_{8bit} - 160)^4}{(255-160)^4} \text{ if } R_{8bit} \geq 160. \qquad \text{Equation 1}$$

$$\Delta B = -6 + \frac{6\times(160 - B_{8bit})}{160} \text{ if } B_{8bit} < 160, \text{ and } \quad -6 + \frac{6\times(B_{8bit} - 160)^4}{(255-160)^4} \text{ if } B_{8bit} \geq 160. \qquad \text{Equation 2}$$

Hereinafter, a logic flow for obtaining ACC data $R_{ACC}$ and $B_{ACC}$ for R and B image data $R_{8bit}$ and $B_{8bit}$ using these Equations 1 and 2 will be described in detail with reference to FIG. 8.

First, as shown in FIG. 8, when 8-bit R image data $R_{8bit}$ is inputted, the input data is compared with a predetermined boundary value, i.e., 160 (S501).

If the R image data $R_{8bit}$ is larger than the boundary value (160), subtraction of the boundary value (160) from the R image data $R_{8bit}$ is performed (S502). Thereafter, multiplication of the result ($R_{8bit}$−160) of the subtraction by 1/(255−160) is performed by multiplying ($R_{8bit}$−160) by 11 and rounding the lower tenth bit (S503) since 1/(255−160) is approximately equal to 11/1024. Next, the operations for obtaining the square and the fourth power of (($R_{8bit}$−160)×11/1024) are sequentially performed by using pipelines in ASIC (S504 and S505). Multiplying the result $((R^{8bit}-160)\times 11/1024)^4$ of the operations by six (S506) and subtracting the result $(6\times((R_{8bit}-160)\times 11/1024)^4)$ from six results in ΔR given by Equation 1 (S507).

If the R image data $R_{8bit}$ is smaller than the boundary value (160), subtraction of the boundary value (160) from the R image data $R_{8bit}$ is performed (S511). Thereafter, multiplication of the result (160−$R_{8bit}$) of the subtraction by 1/160 is performed by multiplying (160−$R_{8bit}$) by 13 and rounding the lower 11th bit (S512) since 1/160 is approximately equal to 13/2048. Next, Multiplying (160−$R_{8bit}$)×13/2048 by six (S513), and subtracting the result 6×((160−$R_{8bit}$)×11/1024) from six results in ΔR given by Equation 1 (S514).

10-bit ACC data $R_{ACC}$ for the R image data is obtained from ΔR obtained at the steps S507 or S514 by multiplying the 8-bit R image data by four to convert into 10-bit data and adding ΔR to the result of the multiplication (S508).

ACC data $B_{ACC}$ for B image data $B_{8bit}$ can be also calculated by a similar logic as described above.

According to the fourth embodiment of the present invention, ACC data for respective image data is obtained by the operations of ASIC without storing ACC data in a LUT of the R, G and B data correction units 510, 520 and 530, and thus, a memory (ROM or RAM) for storing the LUT is not required. To prevent layers of ASIC from changing in case that such operations are performed only by using logics of ASIC, a few parameters required for performing the operations may be stored in a memory of the R, G and B data correction units 510, 520 and 530.

For instance, when, in the fourth embodiment of the present invention, a few parameters as shown in Table 1 are stored in a memory, the memory of the R data correction unit 510 may have data of 48 bits.

TABLE 1

| Parameters | fourth embodiment | Symbols |
|---|---|---|
| Boundary value representing gray boundary | 160 | BB |
| The maximum variation | 6 | MD |
| Frequency of multiplication under boundary | 1 | DO |
| Frequency of multiplication under boundary | 4 | UO |
| Inverse number of divider under boundary | 1/160 | DN |
| Inverse number of divider under boundary | 1/(255-160) | UN |

In the fourth embodiment of the present invention, (respective 8-bit) data corresponding to the symbols BB, MD, DO, UO, DN and UN in TABLE 1 is stored in the R, G and B data correction units 510, 520 and 530 of the first embodiment, and, as shown in FIG. 9, these symbols are loaded to perform a logic operation.

The corrected ACC data $R_{ACC}$ according to the fourth embodiment of the present invention as described above has color temperature lower than color temperature of the source image data, e.g., R image data $R_{8bit}$ as a whole as shown in FIG. 10. Accordingly, it can be corrected to have desired color temperature.

According to the fourth embodiment of the present invention, since each of the R, G and B data correction units 510, 520 and 530 has a memory with 48 data bits, the capacity of the memory is decreased. In addition, the R, G and B data correction units 510, 520 and 530, the external ACC data storage 700 and the internal ACC data storage 800 in the second and the third embodiments have such data bits, i.e., 48 data bits, and thus, capacities of the memories are also decreased.

Furthermore, when the logic itself is implemented to perform such operation without storing the data in the memory, the memory may not be employed. In this case, however, there is a problem that the LCD does not have flexibility for a variety of characteristics of the liquid crystal panel assembly.

The ACC data has been calculated using a polynomial of high order such as Equations 1 and 2 in the fourth embodiment. Since the operation for such a polynomial requires several multiplications, the pipelines of ASIC may be complicated. This problem is solved by lineation of the high order equation.

Now, a fifth embodiment of making the equations for ACC data linear will be described with reference to FIGS. 11 to 13.

Figure 11:
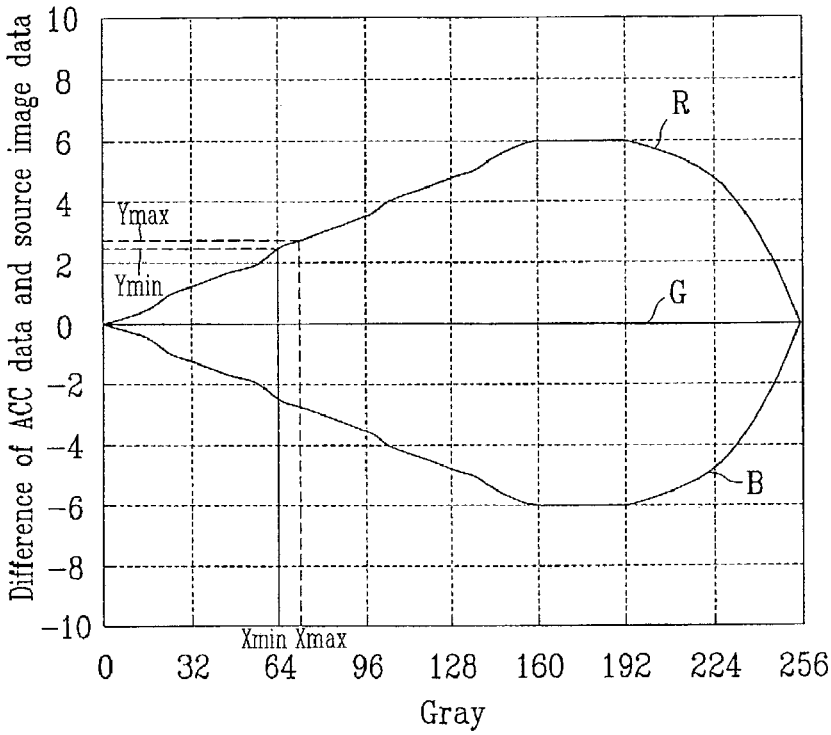
FIG. 11 shows the division of sections in a graph for illustrating ACC data according to a fifth embodiment of the present invention.
Figure 12:
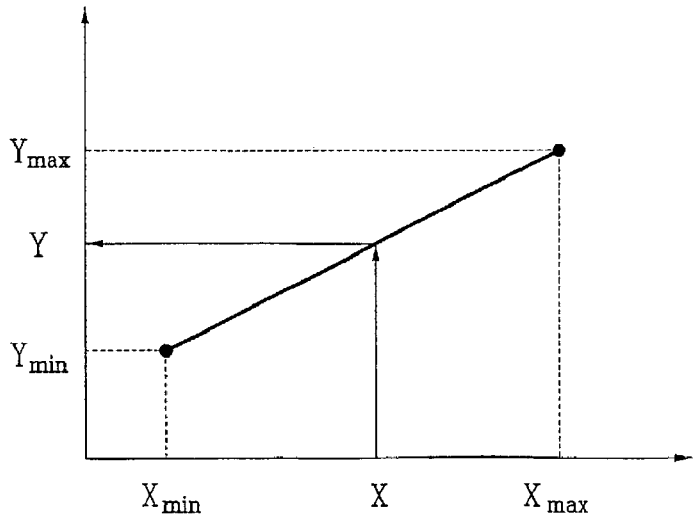
FIG. 12 shows one section in the graph of FIG. 11.

FIG. 11 shows a graph illustrating the division of sections for generating ACC data according to a fifth embodiment of the present invention, and FIG. 12 shows one section in the graph of the FIG. 11. FIG. 13 shows corrected ACC data and source image data according to the fifth embodiment of the present invention.

The fifth embodiment of the present invention calculates the difference between ACC data and source image data by dividing grays into several sections and lineation of the curve segment in each section. For example, the abscissa representing gray in the graph showing the difference between ACC data and source image data ("source data") in FIG. 11 is divided by a predetermined intervals, the curve segment in each section can be approximated as a line segment.

Thus, as shown in FIG. 12, if only boundary points [(Xmin, Ymin), (Xmax, Ymax)] are given for each section in the graph, the differences of ACC data and source image data for a gray in the section may be obtained using Equation 3.

$$Y = Y_{\min} + \frac{(Y_{\max} - Y_{\min})}{(X_{\max} - X_{\min})}(X - X_{\min}) \qquad \text{Equation 3}$$

where $X_{min}$ and $X_{max}$ are gray values (source image data) at the boundaries of the section, and $Y_{min}$ and $Y_{max}$ are the difference between the source image data $X_{min}$ and $X_{max}$ and ACC data therefor. X is a gray value in the section and Y is the difference between the gray value X and the ACC data for the gray value X.

According to Equation 3, ACC data for a gray value X in the section may be calculated if the gray values ($X_{min}$, $X_{max}$) and the difference ($Y_{min}$, $Y_{max}$) between the gray value ($X_{min}$ and $X_{max}$) and the ACC data therefor are known.

The gray sections are made by powers of two, the division in Equation 3 may be implemented as shift operation of bits, and the sections for a source image data may be identified by a few higher bits of the input source image data. For example, when the input source image data represents 256 grays (i.e., 8 bits) and each section includes eight grays, the division in Equation 3 is implemented as only 3-bit shift of the calculated result and the sections for respective input source image data is identified by higher five bits.

Accordingly, the fifth embodiment of the present invention only stores ACC data at the boundaries. Since the number of the boundaries of each section is two, two parameters may exist. However, since $Y_{max}$ of a section equals to $Y_{min}$ of the next section, it is sufficient to store only one parameter for each section. For example, in case 8-bit source image data is inputted and each section includes 8 grays, the number of the sections is 32, and thus 32 boundary values are required to be stored.

According to the fifth embodiment of the present invention, since each of the R, G and B data correction units 510, 520 and 530 has a memory with 320 data bits (=32×10, for 8-bit input source image data, eight-gray including sections, and 10-bit ACC data), a capacity of the memory is decreased. In addition, since the R, G and B data correction units 510, 520 and 530, the external and internal ACC data storage 700 and 800 have only such data bits (320 data bits), a capacity of the memory is considerably decreased.

Here, when the length of each section is increased, the capacity of the memory is more decreased, while the correctness is apparently decreased. For example, in case that each section includes 16 grays, the number of the sections are 16, the data bits of memory required for each of the R, G and B data correction units are 160 bits (=16×10), and thus, the capacity thereof is decreased to 6.25% (=3×160/7680). In case of 32 gray including sections, the number of the sections is eight, the data bits are 80 bits (=8×10), and thus the capacity of the memory is decreased to 3.125%.

Figure 13:
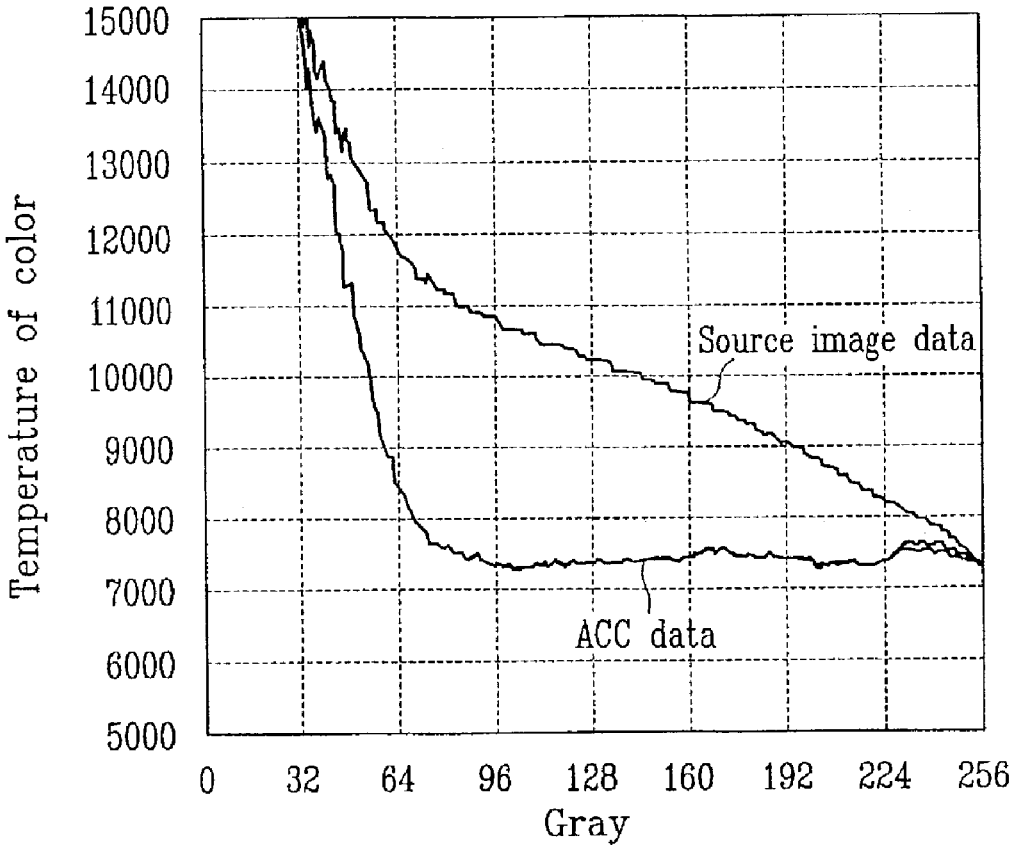
FIG. 13 shows corrected ACC data and R source image data according to the fifth embodiment of the present invention.

The corrected ACC data $R_{ACC}$ according to the fifth embodiment of the present invention as described above have color temperature lower than color temperature of the R image data (source data) as shown in FIG. 13. Accordingly, it can be corrected to have desired temperature of color.

Although the examples of the first to the fifth embodiment illustrate the generation of 10-bit ACC data for 8-bit source image data (256 grays), the present invention is not limited to these examples but is applicable to all the cases generating m-bit ACC data for n-bit source image data.

According to the present invention as described above, it is possible to considerably decrease a capacity of memory required to generate ACC data by color-correcting image data. According to the present invention, a few parameters may be stored in the memory required for logic operation generating ACC data or the ACC data may be stored in the memory as a look up table type.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A liquid crystal display comprising:

a signal controller comprising a logic circuit and a multilevel graying unit, the logic circuit classifying n-bit source image data into at least two sections by dividing grays and correcting the n-bit source image data into m-bit first corrected data based on gamma correction data predetermined by gamma characteristics of the n-bit source image data for each of the at least two sections, the multilevel graying unit converting the m-bit first corrected data into second corrected data with a bit number equal to or less than the n bits of the source image data;

a data driver outputting data voltages corresponding to the second corrected data from the signal controller; and a memory storing a parameter for correcting the n-bit source image data into the m-bit first corrected data;

wherein the logic circuit calculates the m-bit first correction data assuming that the gamma correction data in each of the at least two sections is linearly dependent on grays; and wherein the m-bit first correction data is determined by $$Y_{\min} + \frac{(Y_{\max} - Y_{\min})}{(X_{\max} - X_{\min})}(X - X_{\min})$$

where $X_{min}$ and $X_{max}$ are minimum and maximum boundary values of each of the at least two sections, $Y_{min}$ and $Y_{max}$ are the gamma correction data for $X_{min}$ and $X_{max}$, and X is the n-bit source image data.

2. The liquid crystal display of claim 1, wherein the memory is provided in the signal controller or external to the signal controller.

3. The liquid crystal display of claim 1, wherein the memory comprises a nonvolatile memory, and wherein the nonvolatile memory is provided within the signal controller.

4. The liquid crystal display of claim 1, wherein the memory is provided external to the signal controller, and wherein the signal controller further comprises a volatile memory temporarily storing the parameters stored in the memory and a memory controller loading the parameters stored in the memory to the volatile memory.

5. The liquid crystal display of claim 1, wherein the memory further comprises first and second nonvolatile memories provided in and external to the signal controller, respectively, and wherein the signal controller further comprises a volatile memory temporarily storing the parameters stored in the first and the second nonvolatile memories and a memory controller loading the parameters stored in the first and the second nonvolatile memories to the volatile memory.

6. The liquid crystal display of claim 1, wherein the m bits of the first corrected data are equal to or greater than the n bits of the source image data.

7. The liquid crystal display of claim 1, wherein m is greater than n.

8. A liquid crystal display comprising:

a signal controller comprising a logic circuit and a multilevel graying unit, the logic circuit classifying n-bit source image data into at least two sections by dividing grays and correcting the n-bit source image data into m-bit first corrected data based on gamma correction data predetermined by gamma characteristics of the n-bit source image data for each of the at least two sections, the multilevel graying unit converting the m-bit first corrected data into second corrected data with a bit number equal to or less than the n bits of the source image data;

a memory storing a parameter for correcting the n-bit source image data into the m-bit first corrected data; and a data driver outputting data voltages corresponding to the second corrected data from the signal controller;

wherein the logic circuit calculates correction values in a first section and a second section differentiated by a boundary value based on the following:

$$MD_1 - MD_1 \times \left\{\frac{(D - BB)}{UN}\right\}^{UO}; \text{ and}$$

-continued $$MD_2 - MD_2 \times \left\{\frac{(BB - D)}{DN}\right\}^{DO},$$

respectively, where D is the n-bit source image data, BB is the boundary value, UN and DN are respective sizes of the first and the second sections, UO and DO are orders of respective polynomials in the first and the second sections, and $MD_1$ and $MD_2$ are the maximum values of differences between the n-bit source image data and the gamma correction data for the first and the second sections.

9. The liquid crystal display of claim 8, wherein the memory stores the maximum values of the differences between the n-bit source image data and the gamma correction data for the first and second sections, the sizes of the first and the second sections, and the orders of the polynomials in the first and the second sections.

10. A driving apparatus of a liquid crystal display, comprising:

a logic circuit classifying n-bit image data inputted from an external device into first and second sections with respect to a boundary gray value and correcting the n-bit image data into m-bit corrected data based on gamma correction data predetermined by gamma characteristics of the n-bit image data for each of the first and the second sections; and a storage storing operation parameters of the logic circuit, wherein the logic circuit calculates correction values in the first section and the second section based on the following:

$$MD_1 - MD_1 \times \left\{\frac{(D - BB)}{UN}\right\}^{UO}; \text{ and}$$

$$MD_2 - MD_2 \times \left\{\frac{(BB - D)}{DN}\right\}^{DO},$$

respectively, where D is the n-bit image data, BB is the boundary gray value, UN and DN are respective sizes of the first and the second sections, UO and DO are orders of respective polynomials in the first and the second sections, and $MD_1$ and $MID_2$ are the maximum values of differences between the n-bit image data and the gamma correction data for the first and the second sections.

11. A driving apparatus of a liquid crystal display, comprising:

a logic circuit classifying n-bit image data into a plurality of sections on the basis of given number of grays and correcting the n-bit image data into m-bit corrected data based on gamma correction data predetermined by gamma characteristics of the n-bit image data for each of the sections; and a storage storing the gamma correction data at boundary gray values of each of the sections, wherein the logic circuit converts the n-bit image data into the m-bit corrected data for each of the sections; and wherein the m-bit correction data is determined by a linear line defined by the boundary gray values for each of the sections as determined by:

$$Y_{\min} + \frac{(Y_{\max} - Y_{\min})}{(X_{\max} - X_{\min})}(X - X_{\min})$$

where $X_{min}$ and $X_{max}$ are minimum and maximum boundary gray values of each of the sections, $Y_{min}$ and $Y_{max}$ are the gamma correction data for $X_{min}$ and $X_{max}$, and X is the n-bit image data.

12. The driving apparatus of the liquid crystal display of claim 11, wherein the logic circuit receives the n-bit image data from an external device.

* * * * *